US005655627A

United States Patent [19]

Horne et al.

[11] Patent Number: 5,655,627

[45] Date of Patent: Aug. 12, 1997

[54] ELEVATOR DOOR RESTRICTOR

[75] Inventors: Gregory L. Horne, Watauga; Tom J. Harrison, Grapevine, both of Tex.

[73] Assignee: Advanced Microcontrols, Inc., Fort Worth, Tex.

[21] Appl. No.: 512,489

[22] Filed: Aug. 8, 1995

[51] Int. Cl.[6] ..... B66B 13/06

[52] U.S. Cl. ..... 187/335; 187/314; 187/317; 187/313

[58] Field of Search ..... 187/335, 317, 187/314, 331, 313, 316

[56] References Cited

U.S. PATENT DOCUMENTS

| | | | |
|---|---|---|---|
| 2,200,074 | 5/1940 | Bouton . | |
| 2,758,676 | 8/1956 | Nikazy | 187/317 |
| 2,859,835 | 11/1958 | Borden . | |
| 2,902,117 | 9/1959 | Pierson | 187/317 |
| 2,996,152 | 8/1961 | Olexson et al. . | |
| 3,285,369 | 11/1966 | Hornung et al. . | |
| 4,004,655 | 1/1977 | Kraft et al. | 187/317 |
| 4,364,454 | 12/1982 | Glaser et al. . | |
| 4,436,184 | 3/1984 | Dorman et al. | 187/331 |
| 5,250,765 | 10/1993 | Mizuno et al. | 187/317 |

OTHER PUBLICATIONS

ANSI/ASME A17.1–1981, Safety Code for Elevators and Escalator, Section 211, pp. 70–71 Sep. 1981.

*Primary Examiner*—William E. Terrell
*Assistant Examiner*—Khoi H. Tran
*Attorney, Agent, or Firm*—James E. Bradley

[57] ABSTRACT

An elevator is provided with a car, an inner door mounted to the car and outer doors mounted to floor openings which define floor zones. The inner door registers with the outer doors when the car is disposed within one of the floor zones. The elevator includes a door restrictor having an electric solenoid mounted to the car so that the inner door cannot be opened more than four inches when the elevator is between floor zones. The electric solenoid has a plunger which is normally in an extended position to block the inner door from opening. Power will only be applied to the electric solenoid to lift the plunger from the extended position to a retracted position to allow the inner door to be fully opened when both the car is disposed within a floor zone and the inner doors are being initiated to move slightly by the main elevator controls. A floor zone sensor is mounted to the car for detecting when the elevator is disposed within one of the floor zones. A door sensor is also mounted to the car for detecting when the inner door is being opened by the main elevator controls. A controller operates the electric solenoid to lift the plunger from the extended position to the retracted position in response to receiving both a door data signal from the door sensor and a floor zone data signal from the floor zone sensor.

16 Claims, 4 Drawing Sheets

ELEVATOR DOOR RESTRICTOR

BACKGROUND OF THE INVENTION

1. Field of the Invention

The present invention relates in general to controls for elevators, and in particular to an elevator door restrictor for preventing elevator doors from being opened between floors.

2. Description of the Prior Art

A new national standard for elevator codes has recently been promulgated by the American Society of Mechanical Engineers, and has been widely adopted by many local building code authorities. It requires door restrictors for blocking the inner doors of elevators from being pushed open more than a total of four (4) inches when elevator cars are disposed between floors. The code provides a standard that the elevator must be within eighteen (18) inches of being perfectly aligned at a floor before the door restrictor allows the inner doors to be pushed open. Preferably the inner elevator doors may be pushed open a slight distance, not more than a total of four (4) inches, so that persons trapped within an elevator car between floors may look out into the elevator shaft, call for help and circulate fresh air.

Prior art elevator door restrictors have been provided by mechanical latches which prevent the inner doors of elevator cars from being pushed open when the elevator cars are between floors. The prior art mechanical latches have mechanical linkages which engage cams located at each floor to move the mechanical latches from a latched position to an unlatched position when the elevator passes by each floor. These prior art mechanical latches do not prevent the inner doors from being pushed open while elevator cars are moving past a floor. Additionally, the mechanical linkages are typically noisy, making noise as the elevator passes each floor.

SUMMARY OF THE INVENTION

An elevator is provided with a car, an inner door mounted to the car and outer doors mounted to floor openings which define floor zones, wherein the inner door registers with the outer doors when the car is disposed within one of the floor zones. The elevator includes a door restrictor having an electric solenoid mounted to the car so that the inner door cannot be opened more than four inches when the elevator is between floor zones. The electric solenoid has a plunger which is normally in an extended position to block the inner door from opening. Power will only be applied to the electric solenoid to lift the plunger from the extended position to a retracted position to allow the inner door to be fully opened when both the car is disposed within a floor zone and the inner doors are being opened by the main elevator controls. A photo sensor is mounted to the car to provide a floor zone sensing means for detecting when the elevator is disposed within one of the floor zones. A photo sensor is mounted to the car to provide a door sensing means for detecting when the inner door is being opened by the main elevator controls. A controller operates the electric solenoid to lift the plunger from the extended position to the retracted position in response to receiving both a door data signal from the door sensing means and a floor zone data signal from the floor zone sensing means.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
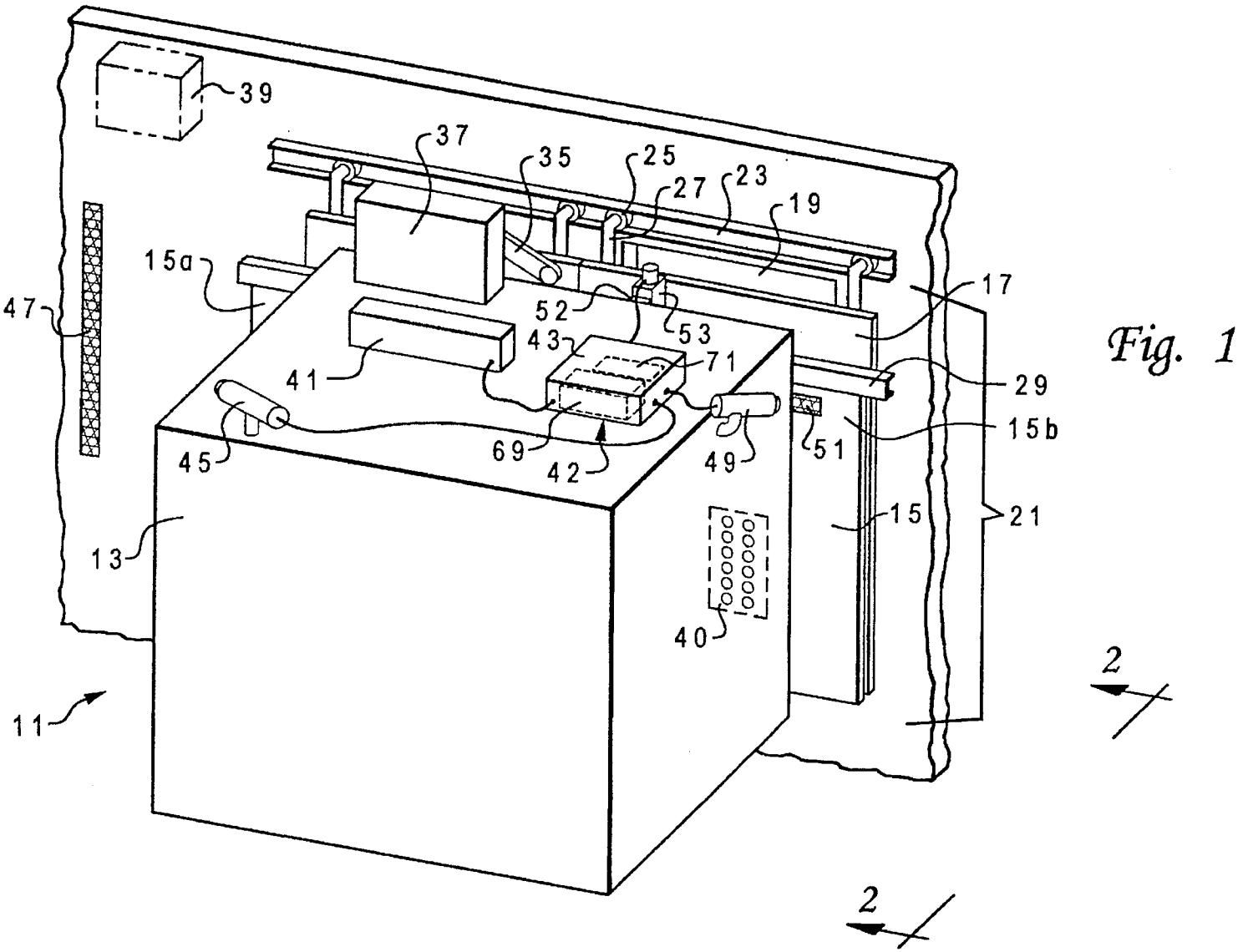
FIG. 1 is a perspective view depicting an elevator having a door restrictor made according to the present invention.

FIG. 1 is perspective view of elevator 11 having car 13 to which inner doors 15 are mounted. Car 13 travels between floors at which inner doors 15 register with outer doors 17. As shown in FIG. 1, inner doors 15 includes two doors 15*a* and 15*b* which open in opposite directions, one to the left and the other to the right. The two doors 15 are connected together so that one can not be moved without the other moving in an opposite direction. Outer doors 17 cover floor openings 19. Floor openings 19 define floor zones 21, one of which elevator car 13 is shown being disposed within. Outer doors 17 are preferably mechanically connected with inner doors 15 at each floor so that they will be moved open and closed as inner doors 15 are opened and closed.

Figure 2:
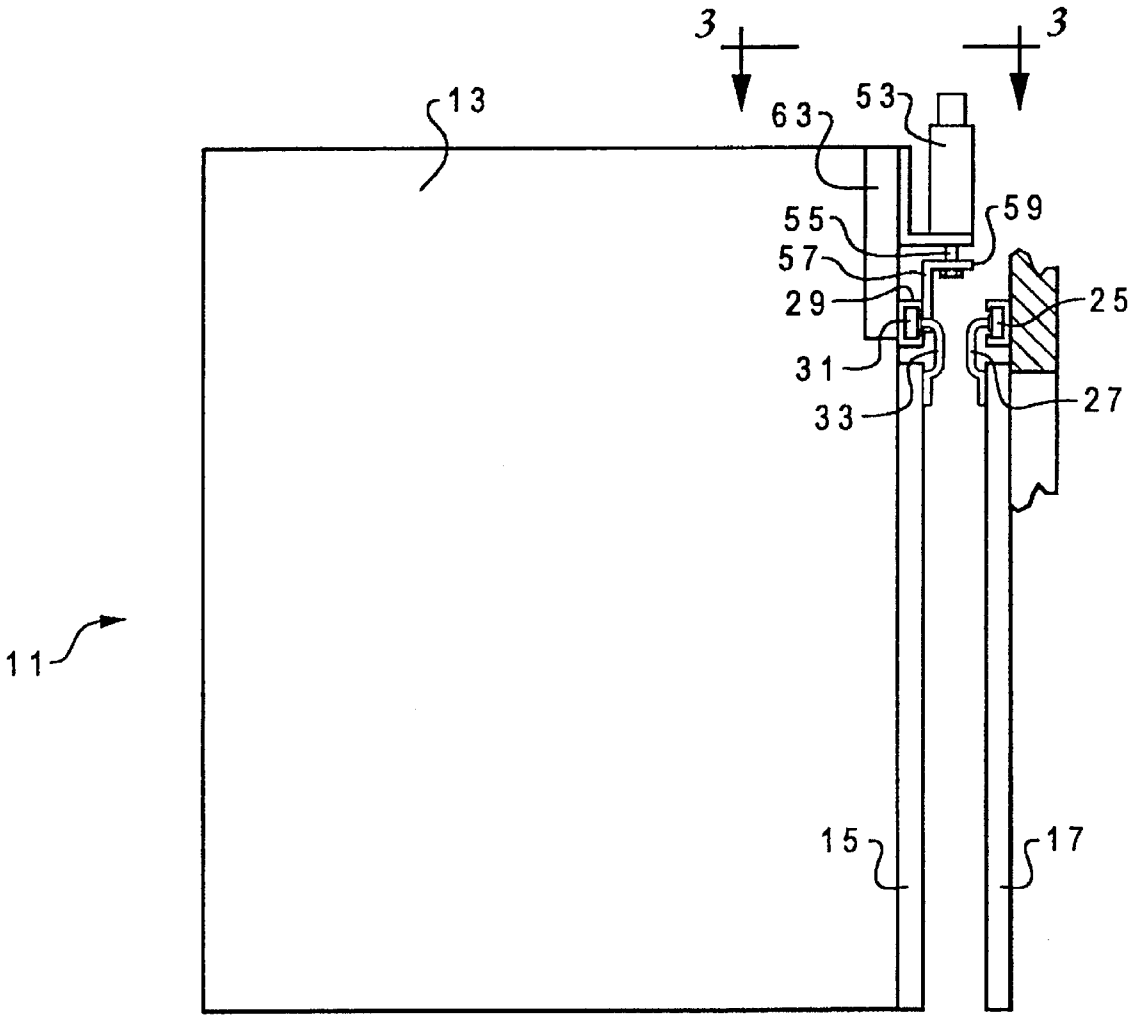
FIG. 2 is a sectional view of the elevator of FIG. 1, taken along section line 2—2 of FIG. 1.

FIG. 2 is a side view of elevator 11, taken along line 2—2 of FIG. 1. Outer doors 17 are mounted to outer door tracks 23 which extend above floor opening 19. Rollers 25 extend into outer door tracks 23 for movably supporting outer doors 17. Mounting brackets 27 are used to mount roller 25 to outer doors 17. Inner doors 15 are mounted to car 13 by inner door track 29. Rollers 31 extend from mounting brackets 33 into inner door tracks 29 to movably support inner doors 15. Mounting brackets 33 fasten rollers 31 to inner doors 15.

Figure 3:
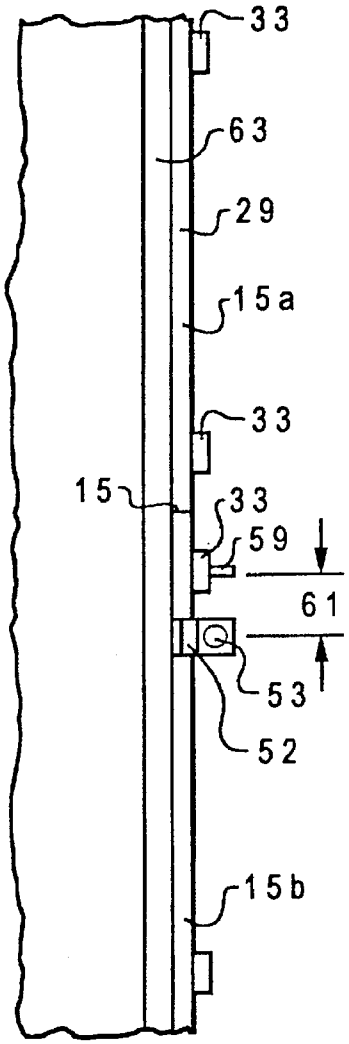
FIG. 3 is a top, sectional view of the elevator of FIG. 1, taken along section line 3—3 of FIG. 2.

Referring to FIGS. 2 and 3, swing arm 35 extends from inner doors 15 to drive motor 37. Main elevator control 39, which is depicted in phantom, is typically located at the top of the elevator shaft and is connected to control panel 40, which is mounted within car 13 for persons to select the floors to which elevator car 13 is moved. Main elevator control panel controls vertical movement of elevator car 13 and operation of drive motor 37 to operate swing arm 35 to open inner doors 15 and outer doors 17. Wiring trough 41 extends on the top of elevator car 13 to provide power to lights which are mounted within car 13.

Referring to FIG. 1, elevator door restrictor 42 of the present invention includes controller 43, a first photo sensor 45 and a second photo sensor 49. Photo sensors 45, 49 are commercially available photoelectric sensors. First photo sensor 45 is mounted to car 13 to provide a floor zone sensing means for detecting when one of reflective targets 47 (one shown) is in close proximity to sensor 45. Reflective targets 47 are preferably strips of tape having a outward facing, reflective surface. In the preferred embodiment, reflective targets 47 (one shown) are each 36 inches long and mounted to the elevator shaft so that the vertical center of one of the reflective targets 47 (one shown) will be detected when car 13 is centered within one of floor zones 21. Reflective targets 47 are up to 36 inches long so that inner doors 15 may begin to be opened while elevator car 13 is still moving into position within one of floor zones 21, within 18 inches of being centered within the floor zone. One of reflective targets 47 is mounted within each floor zone.

Second photo sensor 49 provides a door sensing means for detecting when reflective target 51 has been moved. In FIG. 1, reflective target 51 is shown as being mounted to the car side of one of inner doors 15, door 15*b*. However, in other embodiments, reflective target means 51 may be mounted to the other side of one of inner doors 15, such as on an angle iron mounted facing outer doors 17. As shown in FIG. 1, reflective target 51 is preferably mounted so that it will not be detected until inner door 15*b* has been opened a short distance, which is preferably not more than two (2) inches. Additionally, the opposite end of reflective target 15 should be positioned so that second photo sensor 49 will stop detecting the presence of reflective target 51 a short distance prior to inner door 15*b* being fully opened. In other embodiments, second photo sensor 49 and reflective target 51 may be arranged such that reflective target 51 will only be detected both when inner door 15*b* is fully opened and fully closed. The primary purpose for second photo sensor 49 and reflective target 51 is to detect when doors 15 are being moved, or has been moved a short distance, so that power will not be continually applied solenoid 53 when inner doors 15 are fully opened. Doors 15*a* and 15*b* are connected together so that one will not move without the other being moved.

Photo sensors 45, 49 are preferably mounted at an angle to reflective targets 47, 51, respectively, rather than being mounted to pass light along a line of sight which extends directly perpendicular to reflective targets 47, 51. The mounting angle between a line which extends perpendicular to the flat surface of reflective targets 47, 51 and a line of sight along which photo sensors 45, 49 emit light, respectively, should be between 10 degrees and 45 degrees. This will help prevent false signalling, such as may be occur with shiny surfaces such as stainless steel. Additionally, photo sensors 45, 49 should be installed at a minimum of 6 inches to a maximum of 6 feet from reflective targets 47, 51, respectively.

Referring to FIG. 2, electronic door restrictor 42 of the present invention further includes electric solenoid 53, which provides a latching means. Electric solenoid 53 has a plunger 55 which provides a blocking member which is movable from an extended position to a retracted position. Preferably, plunger 55 will be disposed in the extended position prior to application of power to solenoid 53, and plunger 55 will move to a retracted position after application of power to solenoid 53. Electric solenoid 53 is preferably a 12 volt solenoid.

Referring to FIG. 1, controller 43 controls operation of solenoid 53 in response to data signals detected by photo sensors 45, 49. Controller 43 may be mounted within elevator control panel 40, but preferably is mounted within a separate enclosure, as shown in FIG. 1. Controller 43 includes a lead acid type of storage battery 69 and a circuit board 71. External power is provided by 110 volts AC from wiring trough 41, which is used to power the lights inside of elevator car 13. Battery 69 is preferably a 12 volt DC rated battery, which provides for operation of electronic door restrictor 42 of the present invention when external power from wiring trough 41 is lost.

FIG. 3 is a top, sectional view of elevator 11, taken along section line 3—3 of FIG. 2. Referring to FIGS. 2 and 3, blocking bracket 57 is mounted to one of inner door mounting brackets 33. A blocking rod 59 extends from blocking bracket 57 a short distance 61 from the position which electric solenoid 53 is mounted when inner doors 15 are closed. Distance 61 is preferably not more than two (2) inches when double door types of assemblies are used for inner door 15, in which each of two doors opens in opposite directions, such as doors 15*a* and 15*b*. This prevents inner doors 15*a* and 15*b* from being opened more than a total of four (4) inches before blocking rod 59 encounters plunger 55 of electric solenoid 53. If a single door assembly is used in other embodiments of the present invention in place of inner doors 15, or a double door assembly in which both doors move in the same direction, then the door assembly should not move more than four (4) inches before being blocked by solenoid 53 from opening further so that the total door opening will not be more than four (4) inches. Header 63 is mounted to car 13 and provides a main support to which inner door track 29 and drive motor 37 are mounted.

Figure 4A:
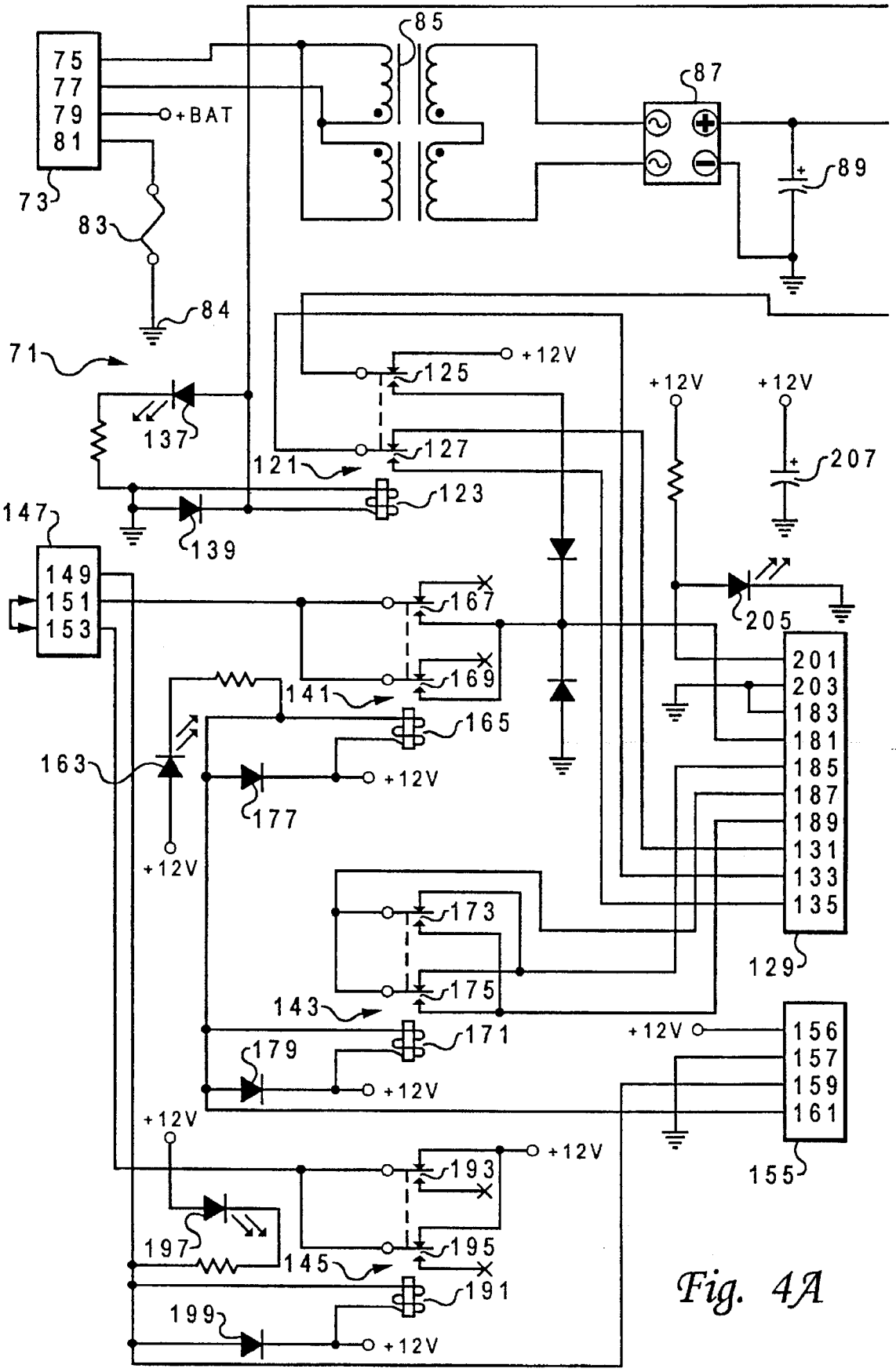
FIGS. 4A and 4B together comprise a schematic diagram depicting the electrical circuits of a controller board for a door restrictor of the present invention.
Figure 4B:
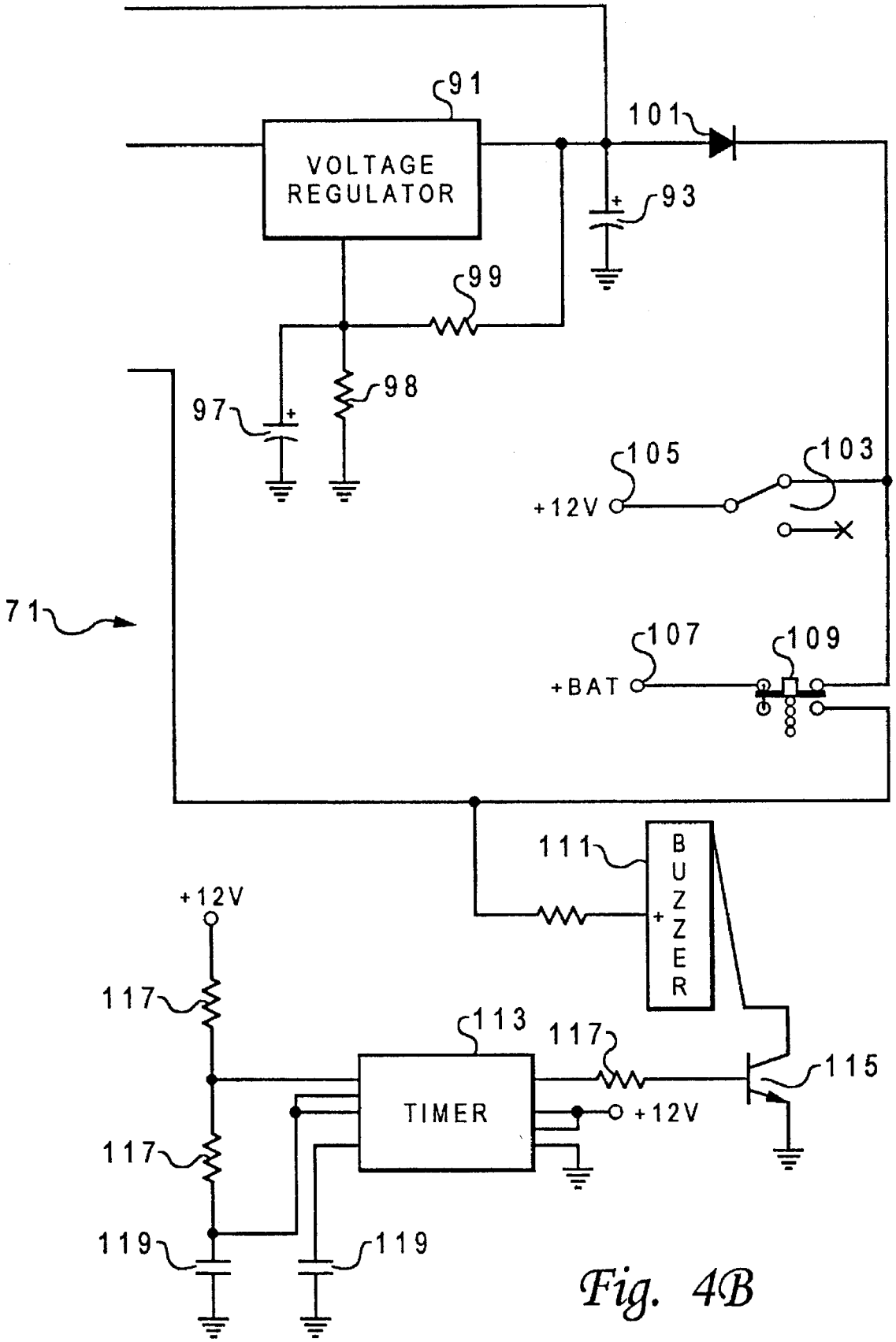

FIGS. 4A and 4B together comprise a schematic diagram depicting circuit board 71, showing the control relays mounted to board 71 in their normal positions, prior to applying power to actuate the relay coils. Circuit board 71 provides a main control means for electronic elevator door restrictor 42 of the present invention. Circuit board 71 has a connector 73 with external power terminals 75, 77 which are preferably connected to 110 volts AC, single phase, found in wiring trough 41 (shown in FIG. 1). A positive battery connection 79 and negative battery connection 81 are used for connecting circuit board 71 to 12 volt rated battery 69. Ground fuse 83 is provided for fusing between the negative lead of external battery 69 and the ground 84 for circuit board 71.

Terminals 75, 77 connect to transformer 85, which is connected to rectifier bridge 87. The rated output of transformer 85 is 16 volts AC, and the rated output of rectifier bridge 87 is 18 volts DC. Capacitor 89 is provided between the output of bridge 87 and ground 84 of circuit board 71. Voltage regulator 91 is connected to the output of bridge 87 and provides a regulated output voltage of 13.6 volts DC, which provides the nominally rated 12 volts DC to power the +12 V nodes of board 71 shown in FIGS. 4A and 4B. Capacitors 93, 97, and resistors 98, 99 are connected to the voltage regulator 91.

The output voltage from regulator 91 passes through diode 101 to on/off switch 103 and test switch 109. Switch 103 is an on/off switch for connecting 12 volt power to node 105, which schematically represents the 12 volt power supplied to the circuit board. Node 107 is connected directly to terminal 79 in connector 73, which is directly connected to battery 69. The output from voltage regulator 109 will charge battery 69, passing through switch 109 in its normal position. Additionally, if switch 103 is in the on position (shown in FIG. 4B), and external power fails so that it is no longer applied to circuit board 71, battery 69 will passelectric current through switches 109 and 103 to node 105 to power circuit board 71. If switch 103 is pushed to the off position, power will not be supplied to circuit board 71 from either the battery 69 or voltage regulator 91.

Test switch 109, when pushed downward, connects electrical power from battery 69 at node 107 to buzzer 111. Buzzer 111 is connected to component 113 which includes a timing circuit so that buzzer 111 will emit a pulsed audible signal. Transistor 115, resistors 117 and capacitors 119 are also connected to timing component 113.

Still referring to FIGS. 4A and 4B, an external power detection relay 121 is schematically depicted by coil 123, and contacts 125, 127. External power detection relay 121 is shown in a normally open position, with power not being applied across coil 123. When the output from voltage regulator 91 is operating at the nominally rated 12 volts DC, power will be applied across coil 123 to energize relay 121. Terminals 131, 133 and 135 of connector 129 are connected across contact 127 of relay 121. Actuating relay 121 will open a normally closed connection across terminals 131 and 133, of connector 129, and will close a normally open connection across terminals 133,135, of connector 129.

Terminals 131 and 133, or 133 and 135, are provided for wiring to the door open button of the elevator control panel 40 mounted within car 13, which is connected to main control panel 39. If external power is no longer applied to circuit board 71, such as if a power failure occurs, the elevator doors 15, 17 will remain open at the first floor at which the elevator stops and the doors open. Since some elevator manufacturers require normally open connections to operate the door button and other elevator manufacturers require normally closed connections, both types are provided by terminals 131, 133 and 135 at connector 129.

When external 110 voltage AC power is no longer applied to circuit board 71, contact 125 of relay 121 will move to the normally closed position (shown in FIG. 4A) to provide 12 volts DC to operate buzzer 111. The battery 69 will then supply 12 volts DC to the +12 volts nodes of circuit board 71 to power buzzer 111. Buzzer 111 will then emit the pulsed tone so that maintenance personnel may be alerted that there has been a failure of external power being applied to the elevator controller, circuit board 71, of the elevator door restrictor 42. Diode 139 is connected to coil 123 to provide surge protection when the relay 121 is actuated and released. Light emitting diode 137 will emit a light signal when external power is being applied so that a nominal 12 volt DC is being supplied by the output of voltage regulator 91.

Connector 147 has jumper terminals 149, 151, and 153. In other embodiments of the present invention, other types of proximity sensors other than photo sensors may be used in place of both photo sensors 45, 49, such as magnetic reed switches, microswitches, inductive proximity sensors and the like. Connector 147 are provided for adapting a circuit board 71 for use when other types of proximity sensors are being used for a door sensing means, in place of photo sensor 49. When photo sensor 49 is utilized for detecting whether inner doors 15 are being moved, a jumper wire is connected across terminals 151 and 153 of connector 147. If another type of proximity sensor is utilized for a door sensing means, other than photo sensor 49, a jumper wire is connected between terminals 149 and 151 of connector 147. The other types of proximity sensors may still be connected across terminals 156, 159 of connector 155, with the normally closed contacts of the proximity sensors connected to terminals 156, 159 to apply 12 volts DC to terminal 159 when not being actuated. These sensors should also be mounted to car 13 so that they will actuate when inner doors 15 are fully opened and fully closed.

Photo sensors 45 and 49 (shown in FIG. 1) are connected to circuit board 71 at connector 155. A plus 12 volt power connection 156 and ground connection 157 are provided. The output from photo sensor 45 (shown in FIG. 1) is connected to terminal 161. The output from photo sensor 47 (shown in FIG. 1) is connected to terminal 159 of connector 155, so that power will be applied to relay 145 when inner doors 15 are either fully opened or fully closed. Photo sensor 45 (shown in FIG. 1) is connected to terminal 161 so that terminal 161 will be connected to ground terminal 157 when a door zone is detected.

Circuit board 71 includes door zone detection relay 141, door zone output signal relay 143 and door limit relay 145. These relays control operation of electric solenoid 53 (shown in FIG. 2). When photo sensor 45 detects a door zone, terminal 161 will be connected to ground terminal 157, causing light emitting diode 163 to be turned on and actuating relays 141, 143. Passing power through coil 165 will actuate relay 141, switching contacts 167, 169 from the normal position (shown in FIG. 4A). Power being applied to coil 171 will actuate relay 143, moving contacts 173, 175 from the normal position (shown in FIG. 4A). In the normal position, without power being applied to relay 145, terminal 185 is connected to terminal 187 of connecter 129. When power is applied to actuate relay 145, contacts 173, 175 are moved from the normal position shown in FIG. 4A, opening the electrical connection between terminals 185 and 187 and closing the electrical connection between terminals 187 and 189. This provides an independent door zone signal, for use with main elevator control circuits, such as controls 39 and panel 40 (shown in FIG. 1). Both normally open and normally closed sets of terminals are provided, with 187 being a common terminal, 185 being a normally closed terminal and 189 being a normally open terminal.

When relay 141 is actuated, by passing current through coil 165 to move contacts 167, 169 from the position shown in FIG. 4A, terminal 151 of connector 147 will be connected to terminal 181 of connector 129. Terminal 181 of connector 129 is used for providing power to solenoid 53. A ground connection is provided through terminal 183 connector 129.

When photo sensor 47 is used, a jumper wire is used to connect terminal 151 to terminal 153 of connector 147. When relay 145 is in the normal position, prior to applying power through coil 191, contacts 193, 195 will be applying 12 volts DC to terminal 153, which is electrically connected to terminal 151 by a jumper wire. This will apply power to terminal 181 for powering the coil of electric solenoid 53 (shown in FIG. 1). However, relay 145 will remain in the actuated position (not shown) until inner doors 15 begin to open and reflective strip 51 passes in front of photo sensor 49. Terminal 159 is connected to the normally closed contacts of photo sensor 49, so that power will not be applied across contacts 193, 195 until doors 15 begin to open at a particular floor. Prior to photo sensor 49 detecting reflective strip 51, contacts 193 and 195 of relay 145 will be disposed in actuated positions, so that plus 12 volts DC will not be connected to terminal 153, but rather terminal 153 will be connected across contacts 193, 195 to an open circuit. Thus, inner doors 51 will remain latched until car 13 stops at a floor and doors 15 begin to open. This prevents solenoid 53 from being actuated at every floor car 13 moves past. Rather, solenoid 53 will only actuate as inner doors 15 are being opened to extend the service life of solenoid 53. When photo sensor 49 detects reflective strip 51, relay 145 returns to the normal state, without current passing through coil 191, moving contacts 193, 195 to the normal position shown in FIG. 4A. This connects 12 volts DC to terminal 153 of connector 147, and to terminals 167, 169 of relay 141.

Light emitting diode 197 is provided to indicate when relay 145 is actuated. Diode 199 is a surge suppression diode for coil 191. External LED connectors 201, 203 are provide to indicate when 12 volts power is applied to circuit board 71. An LED, or other output indicator when connected across terminals 201, 203 will be powered when either external power or battery power is applied to circuit board 71. On board LED 205 also provides an indication of whether either battery power or external power is applied to circuit board 71. Capacitor 207 is provided for connecting between the +12 volt nodes and ground nodes of circuit board 71.

Operation of the present invention is now described. Referring to FIGS. 1–3, when car 13 enters within one of floor zones 21, photo sensor 45 will detect reflective strip 47. This sends a floor zone data signal to controller 43, as discussed above in the discussion for circuit board 71. The floor zone data signal is provided by connecting terminal 161 of connector 155 to ground terminal 157 to actuate relays 141, 143. When car 13 is stopping at one of the floors, within one of floor zones 21, inner doors 15 will be mechanically coupled to outer doors 17 and doors 15, 17 will begin to open. This moves reflective strip 51 in front of photo sensor 49. When photo sensor 49 detects strip 51, it then sends a door data signal to controller 43. The door data signal from photo sensor 49 is provided by removing terminal 159 of connector 155 from connecting to ground terminal 157 to remove power across coil 191 and move relay 145 to a normal state (shown in FIG. 4A).

When both the door data signal is emitted from photo sensor 49 and the floor zone data signal is emitted from photo sensor 45, then controller 43 will actuate solenoid 53 to pull plunger 55 upwards and out of the path of blocking pin 59 so that doors 15 may be fully opened. When inner doors 15 are almost fully open, reflective strip 51 will pass from in front of photo sensor 49, so that photo sensor 49 no longer passes the door data signal. This causes power to be taken off of solenoid 53, and plunger 55 falls from the retracted position back into the extended position. This will extend the service life of solenoid 53 by not continuously applying power as inner doors 15 are held open. For example, cleaning crews may frequently leave elevator doors 15, 17 open while they are cleaning a floor, taking elevator 11 out of service.

Once inner doors 15 begin to close again, reflective strip 51 will again move in front of photo sensor 49, and is detected by photo sensor 49, which then emits the door data signal. With car 13 still in position within one of floor zones 21, photo sensor 45 will still be detecting reflective strip 47. With both the floor zone and door data signals being emitted, solenoid 53 will again be actuated to move plunger 55 from the extended position into the retracted position, allowing blocking member 59 to pass underneath solenoid 53, and doors 15 to fully close. When doors 15 are fully closed, power is removed from solenoid 53 and plunger 55 drops downward to block doors 15 from being fully opened. Then elevator car 13 may be moved to a new floor, at which the door opening sequence may begin again.

If elevator door restrictor 42 fails, then solenoid 53 will remain in the extended position, latching elevator inner doors 15 fully closed so that they cannot be opened more than four (4) inches. Also, when switch 103 (shown in FIG. 4B) is moved to the off position so that voltage is no longer applied to node 105, from either the external power supply of wiring trough 41 or battery 69 (shown in FIG. 1), plunger 55 will remain in the extended position so that blocking member 59 can not pass beneath solenoid 53 and inner doors 15 cannot be opened more than four (4) inches. A maintenance technician will have to physically remove plunger 55 or solenoid 53 from blocking inner doors 15 from opening more than four (4) inches, or return switch 103 to the on position.

The present invention provides several advantages over prior art elevator door restrictors. An electronically controlled relay is provided. The electronically controlled relay prevents the inner doors of the elevator car from being unlatched as the elevator is passing through each floor. This provides much safer operation since the inner doors can not be pushed open as the elevator car is moving through a floor zone. This also provides much quieter operation than mechanical latching mechanisms which are unlatched at each floor. Additionally, if a power failure occurs with the door restrictor of the present invention, at the first floor which the elevator car stops, a door open signal is provided so that the elevator doors will be opened and remain open. A buzzer will sound a pulsed, intermittent, audible signal so that persons in the elevator car will know to evacuate the elevator and notify a service technician to repair the system. Additionally, an independent floor zone signal is provided which may be used with the main elevator controls.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

I claim:

1. In an elevator of the type having a car, a main elevator control, an inner door mounted to the car and outer doors mounted to floor openings located at different floors to define floor zones, wherein the inner door registers with the outer doors when the car is disposed within one of the floor zones, the improvement comprising:

latching means mounted to the car for selectively latching the inner door to prevent the inner door from being moved to a fully open position;

floor zone sensing means for determining when the car is disposed within one of the floor zones, for emitting a floor zone data signal, and for initiating movement of said inner door by said main elevator control in response thereto;

door sensing means mounted to the car for detecting when the inner door is being moved, and emitting a door data signal in response thereto; and control means operable in response to the floor zone data signal and the door data signal for automatically operating the latching means to unlatch the inner door when both of the data signals are received.

2. The elevator according to claim 1, wherein the latching means comprises an electric solenoid having a plunger mounted adjacent to a portion of the inner door for moving to an extended position adjacent to the portion of the inner door to block the inner door from being moved to the fully open position, and for moving to a retracted position away from the portion of the inner door to allow the inner door to be moved to the open position.

3. The elevator according to claim 1, wherein the latching means, the floor zone sensing means, the door sensing means and the control means are operable independent from said main elevator control which selects the ones of the floors to which the elevator is moved.

4. The elevator of claim 1, further comprising:

reflective targets mounted proximate to each of the floor zones, located in positions for detection by the floor zone sensing means when the car is disposed within one of the floor zones; and wherein the floor zone sensing means is a photo sensor which detects the presence of one of the reflective targets when the car is disposed within one of the floor zones.

5. The elevator of claim 1, further comprising:

reflective target means mounted to the inner door for detection by the door sensing means to determine when the inner door is being moved toward the open position; and wherein the door sensing means is a photo sensor which detects the presence of the reflective target means to determine when the inner door is being moved toward the open position.

6. The elevator of claim 1, further comprising:

power loss detecting means for detecting when external electrical power is not being applied to the control means;

a battery for powering the control means and the latching means when external electrical power is not being applied to the control means;

the control means including control logic for emitting a power loss signal when the external power is not being applied thereto; and wherein the power loss signal is applied to said main elevator control to hold the inner and outer doors open.

7. An elevator comprising in combination: a car; plurality of flood openings; a main elevator control;

outer doors mounted to floor openings located at different floors to define vertically spaced apart floor zones;

an inner door mounted to the car, wherein the inner door registers with the outer doors when the car is disposed within one of the floor zones;

a solenoid mounted to the car and having a plunger for moving to an extended position adjacent to a portion of the inner door to block the inner door from being moved to a fully open position, and for moving to a retracted position away from the portion of the inner door to allow the inner door to be moved to the open position, the solenoid defaulting to the extended position;

a reflective target mounted proximate to each of the floor zones;

a first photo sensor mounted to the car for detecting the presence of one of the reflective targets when the car is disposed within one of the floor zones, for emitting a floor zone data signal, and for initiating movement of said inner door by said main elevator control in response thereto;

a reflective target mounted to the inner door;

said second photo sensor mounted to the car for detecting the presence of the reflective target on the inner door to determine when the inner door is being moved, and for emitting a door data signal in response thereto; and a controller operable in response to receiving the floor zone and door data signals for automatically moving the plunger from the extended position to the retracted position when the car is disposed within one of the floor zones and the inner door is being moved.

8. The elevator of claim 7, further comprising:

power loss detecting means for detecting when external electrical power is not being applied to the controller;

a battery for powering the controller and the solenoid when external electrical power is not being applied to the controller; and the controller including control logic for emitting a power loss signal when the external power is not being applied to the controller.

9. The elevator of claim 7, further comprising:

power loss detecting means for detecting when external electrical power is not being applied to the controller;

a battery for powering the controller and the solenoid when external electrical power is not being applied to the controller;

the controller including control logic for emitting a power loss signal when the external power is not being applied to the controller;

an audible alarm mounted to the car; and wherein the controller, when disposed within one of the floor zones, will automatically sound the audible alarm and apply the power loss signal to a main elevator control to hold the inner and outer doors open.

10. The elevator of claim 7, further comprising:

power loss detecting means mounted to the car for detecting when external electrical power is not being applied to the controller;

a battery mounted to the car for powering the controller and the solenoid when external electrical power is not being applied to the controller;

the controller being mounted to the car and including control logic for emitting a power loss signal when the external power is not being applied to the controller;

an audible alarm mounted to the car; and wherein the controller will automatically sound the audible alarm and apply the power loss signal to said main elevator control to hold the inner and outer doors open when the car is disposed within one of the floor zones.

11. A method for use witch an elevator of the type having a car, an inner door mounted to the car and outer doors mounted to floor openings located at different floors to define floor zones, wherein the inner door registers with the outer doors when the car is within one of the floor zones, a main elevator control, the method comprising the steps of:

providing a blocking member, a vertical position sensor, an inner door sensor and a controller for operating the blocking member in response to the vertical position sensor and the inner door sensor;

movably mounting the blocking member to the car, adjacent to the inner door, for selectively moving between an extended position to block the inner door from being moved to a fully open position, and a retracted position for allowing the inner door to be moved to the open position;

mounting the vertical position sensor to the car for detecting when the car is within one of the floor zones for emitting a floor zone data signal, and for initiating movement of said inner door by said main elevator control in response thereto;

mounting the inner door sensor to the car for detecting when the inner door is being moved toward the open position and for emitting a door data signal in response thereto;

connecting the controller to the vertical position sensor, the inner door sensor and the blocking member for operating the blocking member in response to receiving the floor zone data signal and the door data signal;

moving the car into a first one of the floor zones, with the blocking member disposed in the extended position;

wherein the vertical position sensor detects the car being disposed within the first one of the floor zones and emits the floor zone data signal in response thereto;

wherein the inner door sensor detects the inner door being opened and emits the door data signal in response thereto; and then wherein the controller operates the blocking member to move from the extended position responding into the retracted position only when both of the data signals are being received.

12. The method according to claim 11 wherein the blocking member is mounted to the car for allowing the inner door to move a first short distance from a fully closed position and a second distance from the open position when the blocking member is disposed in the extended position, and the method further comprises the steps of:

mounting the inner door sensor to the car for emitting a door data signal when the inner door is moved the first short distance from the fully closed position and detecting when the inner door is moved the second distance from the open position.

13. The method according to claim 11, wherein the vertical position sensor is a photo sensor mounted to the car for detecting reflective targets which are positioned proximate to each of the floor zones for detection by the photo sensor when the car is disposed within a floor zone.

14. The method according to claim 11, further comprising the steps of:

further providing a battery, and the controller with logic for emitting a power loss signal when external power is not being applied thereto;

connecting the controller to said main elevator control panel for automatically applying the power loss signal thereto and opening the inner and outer doors when the elevator stops within one of the floor zones; and upon power loss, once the elevator is stopped within one of the floor zones and the inner and outer doors have been opened, the power loss signal automatically holding the inner and outer doors open.

15. The method according to claim 11, wherein the blocking member is mounted to the car for allowing the inner door to move a first short distance from a fully closed position and a second distance from the open position when the blocking member is disposed in the extended position, and the method further comprises the steps of:

further providing a battery and the controller with logic for emitting a power loss signal when external power is not being applied thereto;

mounting the inner door sensor to the car for emitting a door data signal when the inner door is disposed the first short distance from the fully closed position and for emitting the door data signal when the inner door is disposed the second distance from the fully open position;

connecting the controller to said main elevator control panel for automatically applying the power loss signal to the main elevator control to open the inner and outer doors when the elevator stops within one of the floor zones; and upon power loss, once the elevator is stopped within one of the floor zones and the inner and outer doors have been opened, the power loss signal automatically holding the inner and outer doors open.

16. A method for use with an elevator of the type having a car, an inner door mounted to the car, a main elevator control, and outer doors mounted to floor openings located at different floors to define floor zones, wherein the inner door registers with the outer doors when the car is within one of the floor zones, the method comprising the steps of:

blocking the inner door from fully opening with a blocking member when the car is in motion and when the car is between floor zones;

detecting when the car is within a floor zone emitting a floor zone data signal, and for initiating movement of said inner door by said main elevator control in response thereto;

detecting when the inner door starts to open and emitting a door data signal in response thereto; and then moving the blocking member to an open position in response to receiving both data signals to allow the inner door to open.

* * * * *